US006684781B1

(12) United States Patent
Saitoh

(10) Patent No.: US 6,684,781 B1
(45) Date of Patent: Feb. 3, 2004

(54) PRINTER FOR PRINTING ON WRAPPING PAPER BEING FED TO A CIGARETTE MAKING MACHINE

(75) Inventor: Masayoshi Saitoh, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 0 days.

(21) Appl. No.: 09/869,012

(22) PCT Filed: Dec. 21, 1999

(86) PCT No.: PCT/JP99/07194

§ 371 (c)(1),
(2), (4) Date: Jun. 22, 2001

(87) PCT Pub. No.: WO00/38924

PCT Pub. Date: Jul. 6, 2000

(30) Foreign Application Priority Data

Dec. 24, 1998 (JP) ..... 10-366781

(51) Int. Cl.[7] ..... B41F 31/02; B41K 1/38; B41J 39/28

(52) U.S. Cl. ..... 101/366; 101/335; 101/336; 101/363; 101/364; 101/484; 347/14; 347/15; 347/19

(58) Field of Search ..... 101/366, 335, 101/364, 363, 484, 336; 347/14, 15, 19

(56) References Cited

U.S. PATENT DOCUMENTS

| | | | | |
|---|---|---|---|---|
| 4,066,014 A | * | 1/1978 | van Haaften | 101/157 |
| 4,535,693 A | * | 8/1985 | Belvederi | 101/366 |
| 5,890,431 A | | 4/1999 | Schafer | |

FOREIGN PATENT DOCUMENTS

| | | |
|---|---|---|
| JP | 56-164867 | 10/1981 |
| JP | 60-183149 | 9/1985 |
| JP | 5-261895 | 10/1993 |
| JP | 7-51318 | 11/1995 |
| JP | 10-100385 | 4/1998 |

* cited by examiner

*Primary Examiner*—Andrew H. Hirshfeld
*Assistant Examiner*—Marvin P. Crenshaw
(74) *Attorney, Agent, or Firm*—Birch, Stewart, Kolasch & Birch, LLP

(57) ABSTRACT

A printing device for printing on wrapping paper according to the present invention comprises a cartridge holder (40) having an ink nozzle (18) on the outside thereof and adapted to house an ink cartridge (50); an ink supply passage (79) connecting the ink cartridge (50) and the ink nozzle (18); and a linear actuator (80) supported at the cartridge holder (40) and adapted to push a plunger (52) in the ink cartridge (50) more into the ink cartridge (50).

13 Claims, 4 Drawing Sheets

PRINTER FOR PRINTING ON WRAPPING PAPER BEING FED TO A CIGARETTE MAKING MACHINE

This application is the national phase under 35 U.S.C. §371 of PCT International Application No. PCT/JP99/07194 which has an International filing date of Dec. 21, 1999, which designated the United States of America and was not published in English.

TECHNICAL FIELD

The present invention relates to a printing device for printing predetermined data on wrapping paper in the process of manufacturing cigarettes by continuously wrapping shredded tobacco in the wrapping paper.

BACKGROUND ART

A printing device of this kind is disclosed, for example, in Japanese Patent Unexamined Publication No. Sho 56-164867. The device disclosed there comprises an ink container holding ink, an ink nozzle connected with the ink container by a supply passage, and a gear pump inserted in the supply passage. When the gear pump is actuated, the gear pump supplies the ink held in the ink container through the supply passage to the ink nozzle.

In the case of the above printing device, in order to keep the clearness of data printed on the wrapping paper, that is, the printing density substantially constant, the rate of supplying ink to the ink nozzle needs to be regulated depending on the printing density. The rate of supplying ink is regulated by controlling the actuation of the gear pump, but due to the structure of the gear pump, the flow of the ink delivered from the gear pump inevitably shows pulsation. Therefore, in the above printing device, the rate of supplying ink cannot be regulated precisely.

When cigarettes of another brand are to be manufactured, for which data needs to be printed on the wrapping paper in another color, the ink container needs to be replaced with another one and the supply passage connecting the ink container and the ink nozzle needs to be cleaned.

In the case of the printing device using the gear pump, the supply passage is long and not easy to clean. In addition, the gear pump has a complicated internal structure, therefore, it is not easy to clean the inside of the gear pump.

DISCLOSURE OF THE INVENTION

An object of the present invention is to provide a printing device for printing on wrapping paper that can control the rate of supplying ink easily with a simple structure, and can be prepared easily when printing color is to be changed.

The printing device that attains the above object comprises a printing roller train for printing predetermined data on wrapping paper, having a pair of inlet rollers at a starting end thereof and a printing roller at a terminal end thereof; an ink nozzle for ejecting ink between the pair of inlet rollers; and an ink supply unit for supplying ink to the ink nozzle. Here, the ink supply unit includes an ink cartridge having an ink chamber defined by a movable wall therein and filled with ink, and an ink discharge port, an ink supply passage connecting the ink discharge port of the ink cartridge and the ink nozzle, a linear actuator for pushing the movable wall into the ink cartridge, and control means for controlling action of the linear actuator.

In the above printing device, as the movable wall in the ink cartridge is pushed in by the linear actuator, the ink in the ink cartridge is delivered from the ink discharge port through the ink supply passage to the ink nozzle and ejected from the ink nozzle between the pair of inlet rollers.

The ink is thus ejected from the ink nozzle by the linear actuator pushing the movable wall in. Therefore, the rate of ejecting ink can be controlled precisely by the moving speed of the movable wall. In addition, the rate of ejecting ink from the ink nozzle is free of pulsation. Further, the ink discharge port of the ink cartridge and the ink nozzle are simply connected by the only ink supply passage. Therefore, the ink supply passage can be cleaned easily.

Preferably, the ink supply unit further includes a cartridge holder for detachably housing the ink cartridge therein, and the cartridge holder is located near the ink nozzle. In this case, the ink supply passage connecting the ink cartridge and the ink nozzle can be short.

The cartridge holder may have a nozzle mount for fitting the ink nozzle thereto, at the outside thereof. In this case, the ink supply passage can be further shorter, therefore, further easier to clean.

The nozzle mount may have a nozzle connecting opening adapted to connect with the inside of the ink nozzle. In this case, the ink supply passage can be defined in the cartridge holder.

When the ink supply passage is defined in the cartridge holder, an additional member such as a hose or tube is not needed to connect the ink cartridge and the ink nozzle. The passage for supplying ink from the ink cartridge to the ink nozzle can be provided easily, and the ink supply unit can be a simpler structure.

Specifically, the cartridge holder includes a cylinder that opens at both ends thereof and has a containing chamber adapted to contain the ink cartridge, and an end wall for closing one of the open ends of the cylinder. The end wall has a cartridge connecting hole adapted to be detachably engaged with the ink discharge port of the ink cartridge when the ink cartridge is housed in the cylinder, and the connecting hole provides an end of the ink supply passage. According to this structure, the ink cartridge can connect with the ink passage at the same time the ink cartridge is housed in the cartridge holder.

It is preferably that the end wall of the cartridge holder is detachably attached to the cylinder. In this case, the part of the ink supply passage extending in the end wall can be cleaned in a state that the end wall has been detached from the cylinder. Here, it is more preferably if the cartridge holder is arranged so as to extend along the axes of the inlet rollers and the nozzle mount is provided at the outer peripheral surface of the cylinder of the cartridge holder. In this case, through the open end of the cylinder from which the end wall has been detached, the ink cartridge can be loaded into or unloaded from the cartridge holder without being hindered by the inlet rollers.

The linear actuator is supported at the other open end of the cylinder and has a push rod projecting into the cylinder. The push rod is adapted to push the movable wall when it is expanded and to be separated from the movable wall when it is contracted. According to this structure, the ink cartridge can be unloaded from the cartridge holder making use of the push rod being expanded.

It is preferably that the ink nozzle is detachably attached to the nozzle mount. In this case, the inside of the ink nozzle can be cleaned, separately. The ink nozzle may comprise a separable pair of nozzle halves, and a nozzle passage defined between the nozzle halves to extend from the nozzle connecting opening to the tip end of the ink nozzle. In this case, the inside of the ink nozzle can be cleaned more easily.

The control means comprises a sensor for detecting the density of data printed on the wrapping paper and sending out a corresponding detection signal, and a regulating means for regulating the speed of the movable wall being pushed in by the linear actuator, based on the detection signal from the sensor.

The range of further application of the present invention will become more apparent from the detailed description below. The detailed description below, which will include description of specific examples, relates to a desirable embodiment of the present invention, but various modifications and improvements that can be made in accordance with the concept of the present invention within the range thereof would be apparent to a person skilled in this technical field.

BRIEF DESCRIPTION OF THE DRAWINGS

The present invention will become more apparent from the detailed description below and annexed drawings of an embodiment, where it is to be noted that the description and drawings of the embodiment are not intended to restrict the present invention thereto. Here.

BEST MODE OF CARRYING OUT THE INVENTION

Figure 1:
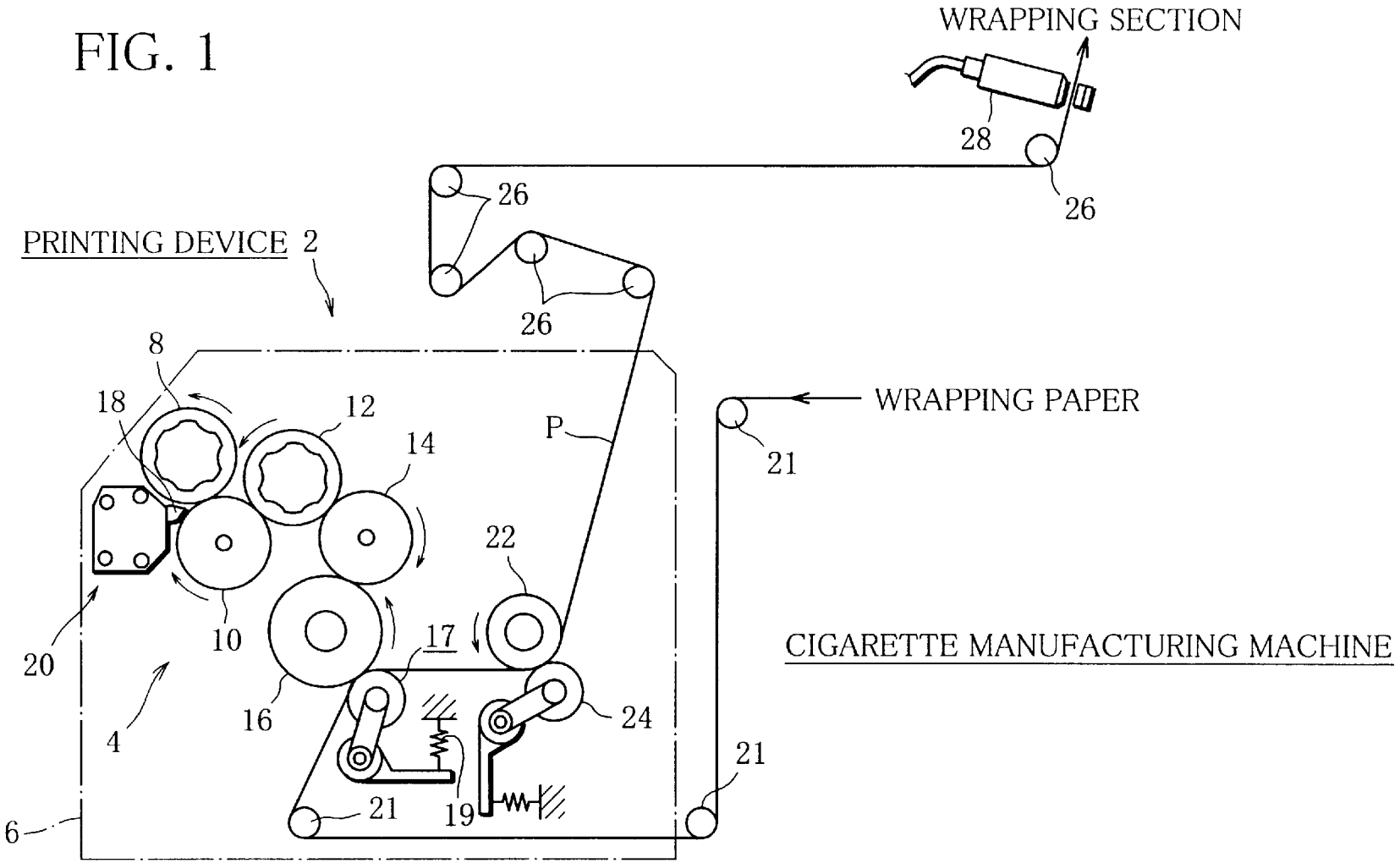
FIG. 1 is an illustration schematically showing an entire printing device incorporated in a cigarette manufacturing machine.

In FIG. 1, a printing device 2 in a cigarette manufacturing machine comprises a train 4 of printing rollers, and each of the rollers are rotatably mounted to a main frame (not shown) of the cigarette manufacturing machine. The printing device 2 is surrounded with a cover 6 that is attached to the main frame with hinges. In FIG. 1, the cover 6 is only indicated with a dashed line.

The printing roller train 4 has, at a starting end thereof, a pair of inlet rollers (ink rollers) 8 and 10. The inlet rollers 8 and 10 are arranged to rotate in contact with each other. The inlet roller 8 is made of metal, and the inlet roller 10 is made of rubber. The inlet roller 10, a spreading roller 12 of metal, a transfer roller 14 of rubber, and a printing roller (plate cylinder) 16 are arranged to rotate in contact with one another. The printing roller 16 is located at the terminal end of the train 4.

The printing device 2 includes an ink nozzle 18. The ink nozzle 18 is arranged so as to direct a tip end thereof toward a nip between the inlet rollers 8 and 10. The ink nozzle 18 is connected with an ink supply unit 20 which will be described later.

When ink is supplied from the ink supply unit 20 to the ink nozzle 18, the ink nozzle 18 ejects ink onto the peripheral surface of the inlet roller 8. The ejected ink is traveled along the peripheral surface of the inlet roller 8 into the nip between the rollers 8 and 10, where the ink is spread to some extent.

Then, the ink on the peripheral surface of the inlet roller 10 moves onto the peripheral surface of the spreading roller 12 and then onto the transfer roller 14. From the transfer roller 14, the ink is supplied to the printing roller 16. Here, the spreading roller 12 reciprocates a predetermined stroke in its axial direction at a predetermined frequency. Therefore, the ink can get more spread on the peripheral surface of the spreading roller 12, and then move from the spreading roller 12 onto the transfer roller 14.

The printing roller 16 rotates in contact with a pinch roller (pressure cylinder) 17 with wrapping paper P between. The pinch roller 17 is pressed against the printing roller 16 by urging force of a spring 19.

The wrapping paper P is drawn out from a wrapping paper roll. The wrapping paper roll is rotatably mounted to the above-mentioned main frame. The wrapping paper P drawn out from the wrapping paper roll is guided by a plurality of guide rollers 21, and then passes between the printing roller 16 and the pinch roller 17. Then, the wrapping paper P passes between a feed roller 22 and a pinch roller 24, and then the paper P is guided by a plurality of guide rollers 26 to a wrapping section of the cigarette manufacturing machine. More specifically, in the wrapping section, the wrapping paper P is, as already known, laid on a garniture tape (not shown) and made to travel with the garniture tape in one direction.

The feed roller 22 is supplied with power from a driving source (not shown) and rotated at a predetermined speed. The pinch roller 24 is pressed against the feed roller 22 by urging force of a spring 25. Further, the feed roller 22 is connected with each of the rollers in the printing roller train 4, by a power transmission line (not shown), and each of the rollers in the printing roller train 4 is rotated at the same peripheral speed as the feed roller 22. Specifically, the power transmission line includes a gear train.

As the feed roller 22 rotates, the wrapping paper P passes between the printing roller 16 and the pinch roller 17 at a constant speed, where the printing roller 16 prints predetermined data on the wrapping paper P at regular intervals. Then the wrapping paper P is supplied to the wrapping section. As already known, in the wrapping section, shredded tobacco is supplied onto the wrapping paper P, and as the wrapping paper P travels with the garniture tape, the supplied shredded tobacco is wrapped in the wrapping paper P. Thus, a tobacco rod is formed continuously. The tobacco rod travels from the wrapping section to a cutting section, where it is cut into individual cigarette rods of a predetermined length.

As shown in FIG. 1, a printing density sensor, what is called a color mark sensor 28 is arranged at the supply path of the wrapping paper P, on the wrapping section side. The color mark sensor 28 comprises a reflection type optical sensor. The color mark sensor 28 detects the printing density of the data printed on the wrapped paper P and sends out a sensor signal corresponding to the detected printing density.

Figure 2:
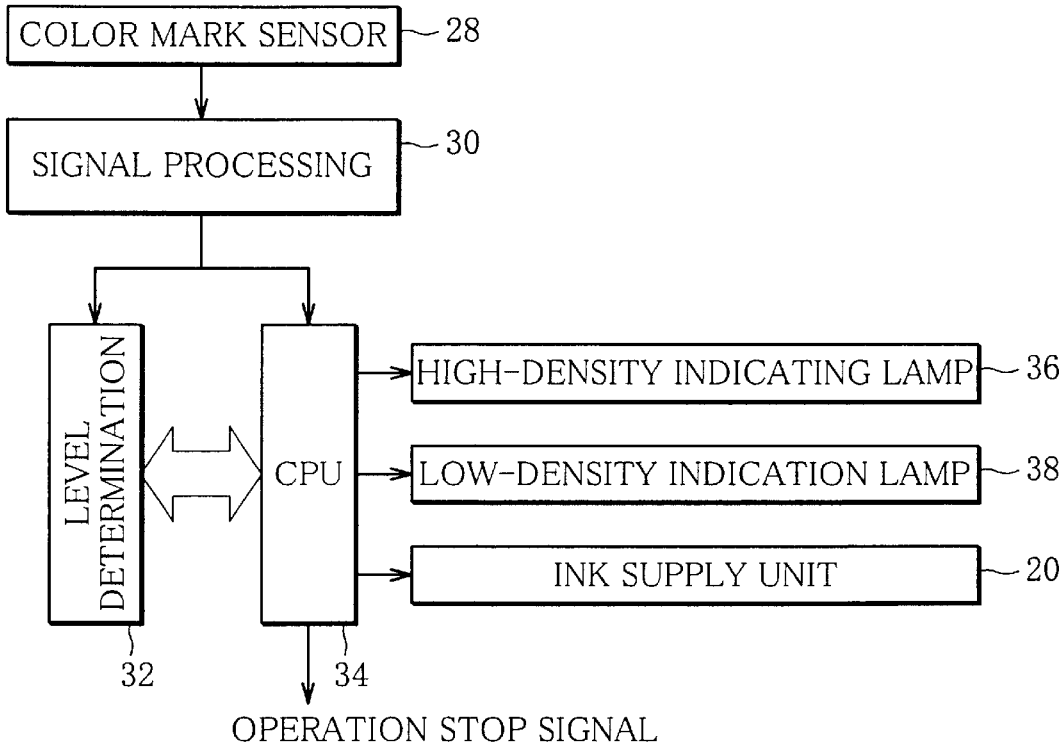
FIG. 2 is a block diagram of a control circuit for the printing device of FIG. 1.

As shown in FIG. 2, the sensor signal is fed from the color mark sensor 28 into a signal processing circuit 30. The signal processing circuit 30 amplifies the sensor signal, samples peak values of the sensor signal, and obtains average printing density of the printed data based on the sampled peak values. The average printing density is supplied from the signal processing circuit 30 to a level determining circuit 32 and a central processing unit (CPU) 34.

The level determining circuit 32 stores an allowable range of the average printing density, and upper and lower limits of the average printing density that are out of the allowable range. The level determining circuit 32 compares the average printing density received from the signal processing circuit 30 with the stored allowable range and upper and lower limits, and supplies the result of the comparison to the CPU 34 as a density signal. The allowable range and upper and lower limits of the average printing density are supplied by an input means (not shown) such as a keyboard, dial or the like, which are supplied via the CPU 34 to the level determining circuit 32 and stored in a memory in the level determining circuit 32.

As the density signal, the level determining circuit 32 sends out a normal signal when the average printing density is in the allowable range, a high-density signal when the average printing density is between the allowable range and the upper limit, a low-density signal when the average printing density is between the allowable range and the lower limit, a too-high-density signal when the average printing density is higher than the upper limit, and a too-low-density signal when the average printing density is lower than the lower limit.

When the CPU 34 receives the high-density signal or the low-density signal, the CPU 34 puts on a high-density indicating lamp 36 or a low-density indicating lamp 38, and sends out, as a control signal, a density increasing signal or a density decreasing signal to the ink supply unit 20. More specifically, when the CPU 34 receives the high-density signal, the CPU 34 sends out the density decreasing signal to the ink supply unit 20. When the density decreasing signal is supplied to the ink supply unit 20, the action of the ink supply unit 20 is controlled so that data may be printed on the wrapping paper P at a decreased density. On the other hand, when the CPU 34 receives the low-density signal, the CPU 34 sends out the density increasing signal to the ink supply unit 20 to control the action of the ink supply unit 20 so that data may be printed at an increased density. Thus, the CPU 34, the signal processing circuit 30 and the level determining circuit 32 constitute regulating means for regulating the ink density of the printed data.

When the CPU 34 receives the normal signal, the CPU 34 turns off both the high-density indicating lamp 36 and the low-density indicating lamp 38, and sends out a density maintaining signal to the ink supply unit 20. The density maintaining signal is to keep the action of the ink supply unit 20 as it is. When the CPU 34 receives the too-high-density signal or the too-low-density signal, the CPU 34 supplies an operation stop signal to the cigarette manufacturing machine to stop the operation of the machine.

Next, the specific structure and action of the ink supply unit 20 will be described referring to FIGS. 3 and 4.

The ink supply unit 20 has a cylindrical cartridge holder 40. The cartridge holder 40 is located near the above-mentioned inlet rollers 8 and 10 and extends parallel to the axes of the rollers 8 and 10. The cartridge holder 40 comprises a cylinder 41 that opens at both ends, and an end wall or end disc 56 that is to close the open end of the cylinder 41 on the inlet roller 8 side. More specifically, the cylinder 41 has a structure divided into a front cylinder 42 located on the end disc 56 side and a rear cylinder 44.

The front and rear cylinders 42 and 44 sandwich a support plate 46 therebetween, and each of the cylinders 42 and 44 are fastened to the support plate 46 by a plurality of fastening bolts 48. In FIG. 3, only the fastening bolts 48 for the rear cylinder 44 are shown, and the fastening bolts 48 for the front cylinder 42 are omitted. The support plate 46 is fixed to the main frame of the cigarette manufacturing machine.

The inside of the cartridge holder 40 is formed as a bore with an annular step. The step bore is coaxial with the cartridge holder 40. The step bore has a large-diameter portion 47 that extends through the front cylinder 42 into the rear cylinder 44, and a small-diameter portion 49 that connects with the large-diameter portion 47. In the large-diameter portion 47, a cylindrical ink cartridge 50 is detachably inserted. The outer diameter and the length of the ink cartridge 50 are equal to the inner diameter and the length of the large-diameter portion 47, respectively, and the ink cartridge 50 has an open end and a closed end. The open end of the ink cartridge 50 faces the small-diameter portion 49, and it is closed by a plunger 52 that serves as a movable wall. The inside of the ink cartridge 50 is an ink chamber 54, and the ink chamber 54 is charged with ink.

The closed end of the ink cartridge 50 is joined to the end disc 56, and the end disc 56 is detachably fastened to the outer end face of the front cylinder 42 by a plurality of fastening screws 58. More specifically, the closed end of the ink cartridge 50 has a discharge tap 60 as an ink discharge port at its center. The discharge tap 60 projects from the closed end of the ink cartridge 50, and is detachably fitted into a cartridge connecting hole 57 in the end disc 56. The end disc 56 has an internal passage 64. The internal passage 64 extends in the end disc 56 from its center toward its peripheral surface in a radial direction, and has an inside end and an outside end. The inside end of the internal passage 56 connects with a connecting pipe 62. The connecting pipe 62 is inserted through a ring seal 59 into the discharge tap 60. The ring seal 59 serves to keep the connecting pipe 62 and the discharge tap 60 fluid-tight, and the cartridge connecting hole 57 and the discharge tap 60 fluid-tight.

The outside end of the internal passage 64 connects with a connecting pipe 66. The connecting pipe 66 extends through a ring seal 67, projects from the end disc 56 into the cartridge holder 40, and connects with an axial hole 68 in the front cylinder 42.

The axial hole 68 extends in the ink cartridge holder 40 in its axial direction, outside the step bore 47, and connects with the above-mentioned ink nozzle 18.

Figure 4:
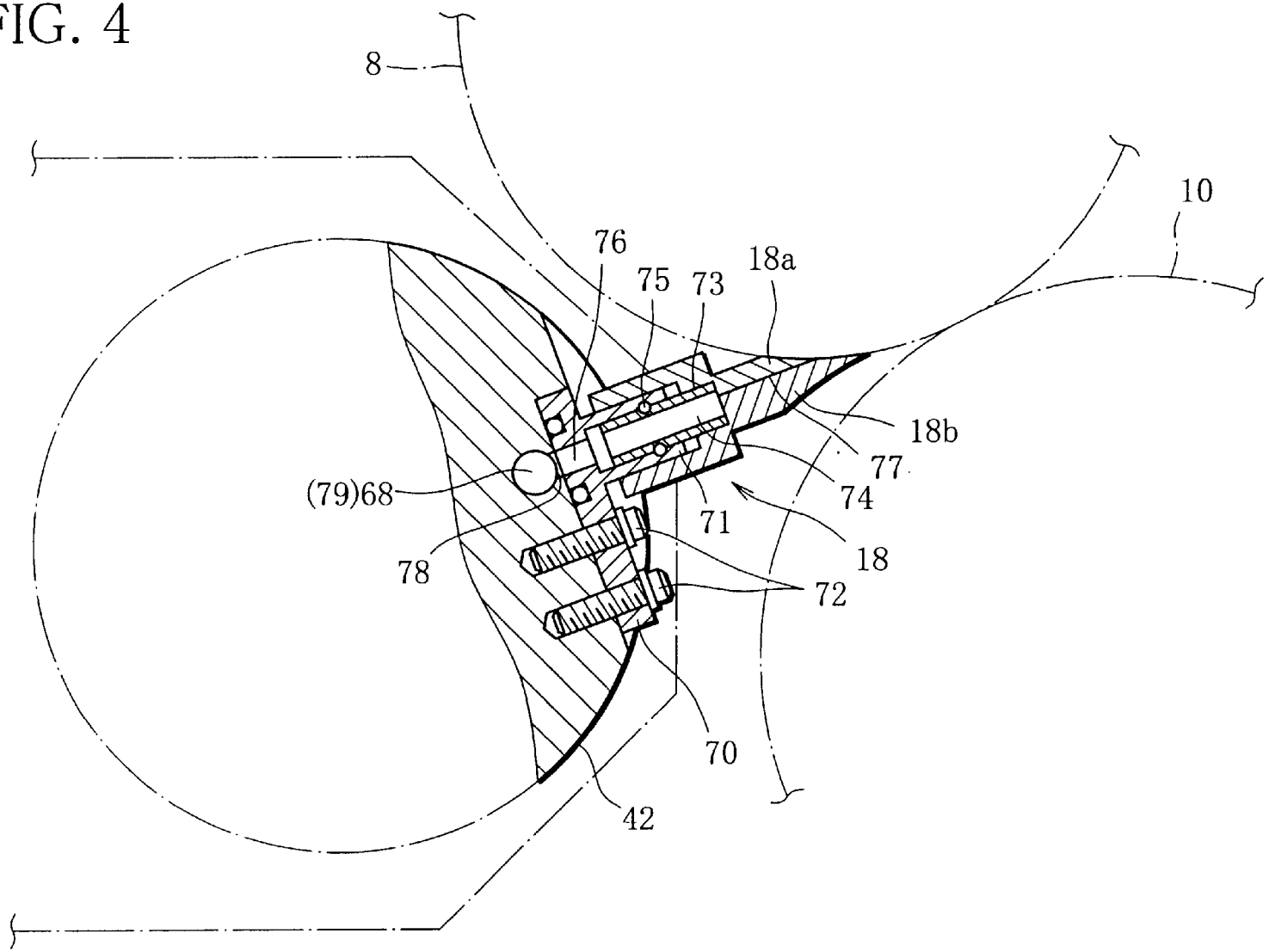
FIG. 4 is a cross sectional view of a portion around an ink nozzle of FIG. 3.

As shown in FIG. 4, the ink nozzle 18 is attached to a nozzle mounting plate 70, and the mounting plate 70 is fastened to the outer peripheral surface of the front cylinder 42 by a plurality of fastening screws 72. The mounting plate 70 has a cylindrical nozzle-connecting tap 71. The nozzle connecting tap 71 projects outward in the front-cylinder 42 radial direction, and is detachably inserted in a base portion of the ink nozzle 18.

The ink nozzle 18 has an inner pipe 73 extending in its base portion. The inner pipe 73 is fitted in the nozzle connecting tap 71 with a ring seal 75 therebetween. Thus, an ink pool 74 in the inner pipe 73 connects with the nozzle connecting tap 71. Further, the mounting plate 70 has a connecting hole 76 bored through. The connecting hole 76 opens into the nozzle connecting tap 71 on one side, and is connected with the axial hole 68 in the front holder 42 by means of a radial hole 78, on the other side.

As shown in FIG. 4, the ink nozzle 18 has two nozzle halves 18*a* and 18*b* that are separably laid one on the other. The ink nozzle 18 has a nozzle passage 77 that are defined between the nozzle halves 18*a* and 18*b*, in the tip end portion of the halves. The nozzle passage 77 has a sheet-like shape. The nozzle passage 77 opens at the tip end of the nozzle 18, and communicates with the inner pipe 73, that is, the nozzle connecting tap 71. The upper surface of the tip end of the ink nozzle 18 is curved in an arc so that the peripheral surface of the inlet roller 8 can slide in contact with the tip end of the ink nozzle 18.

The path from the discharge tap 60 of the ink cartridge 50 to the nozzle passage 77 of the ink nozzle 18 serves as an ink supply passage 79. As apparent from FIG. 3, the entire ink supply passage 79 extends in the cartridge holder 40 and the nozzle mounting plate 70.

Figure 3:
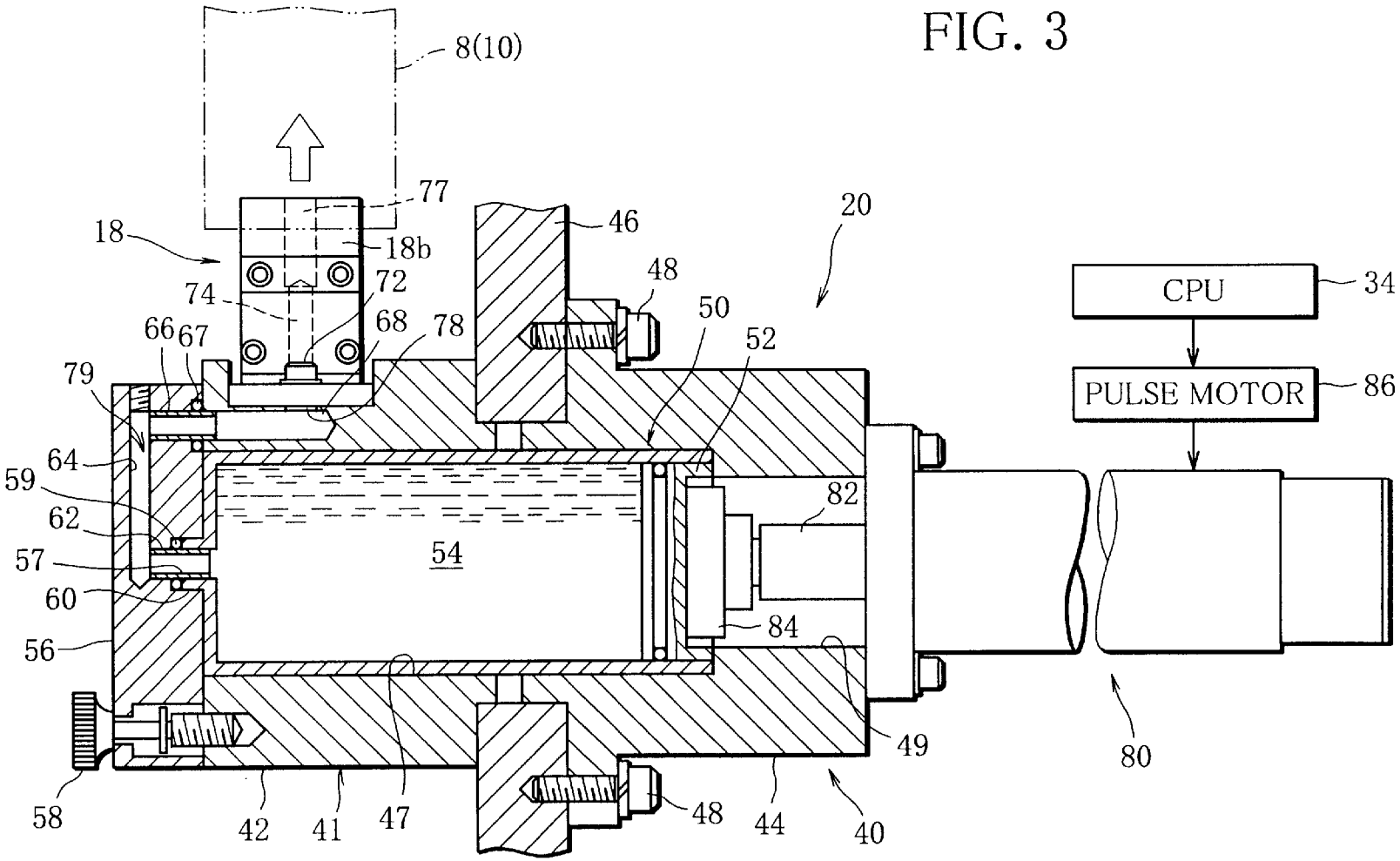
FIG. 3 is an illustration of an ink supply unit of FIG. 1 partly shown in cross section.

As shown in FIG. 3, the cartridge holder 40 supports a linear actuator 80 at the other end. The linear actuator 80 is coupled to the rear end face of the rear cylinder 44 in the manner of flange coupling. The linear actuator 80 has a push rod 82. The push rod 82 coaxially projects into the small-diameter portion 49 in the rear cylinder 44 and the distal end of the push rod 82 is formed as a pusher 84. When the push rod is expanded, the pusher 84 pushes the plunger 52 of the ink cartridge 50 into the ink chamber 54, so that the plunger 52 pressurizes the ink in the ink chamber 54, so that the ink is discharged from the ink chamber 54 though the discharge tap 60 into the ink supply passage. When the push rod 82 is contracted, the push rod 82 can separate from the plunger 52.

The linear actuator 80 is provided with a pulse motor 86. The pulse motor 86 is electrically connected with the CPU 34 mentioned above. As the pulse motor 86 rotates, the rotation is converted into the expansion or contraction of the push rod 82.

Next, how the above-described ink supply unit 20 works will be described.

Before the cigarette manufacturing machine is started, the pusher 84 of the push rod 82 of the linear actuator 80 is in contact with the plunger 52 of the ink cartridge 50, as shown in FIG. 3. When the cigarette manufacturing machine is started up, the CPU 34 first supplies the density maintaining signal to the ink supply unit 20 for a predetermined time, regardless of what density signal is coming in from the level determining circuit 32, so that the push rod 82 of the linear actuator 80 is expanded by the action of the pulse motor 86 at a predetermined speed. As the linear actuator 80 is expanded, the ink in the ink cartridge 50 is pressurized by the pusher 84 and the plunger 52. The ink is therefore discharged from the discharge tap 60 and supplied to the ink nozzle 18 through the ink supply passage 79. As a result, the ink is ejected from the tip end of the ink nozzle 18 between the inlet rollers 8 and 10.

Then, when the level determining circuit 32 supplies the high-density signal to the CPU 34 based on the sensor signal from the color mark sensor 28, the CPU 34 sends out the density decreasing signal to the ink supply unit 20. As a result, the rotational speed of the pulse motor 86 is decreased, so that the speed of the push rod 82, that is, the speed of the plunger 52 moving forward is decreased, and then the rate of the ink ejected from the ink nozzle 18 is decreased.

When the level determining circuit 32 supplies the low-density signal to the CPU 34, the CPU 34 sends out the density increasing signal to the ink supply unit 20 so that the rotational speed of the pulse motor 86 may be increased. As a result, the speed of the plunger 52 moving forward is increased, so that the rate of the ink ejected from the ink nozzle 18 is increased.

When the level determining circuit 32 supplies the normal signal to the CPU 34, the CPU 34 sends out the density maintaining signal to the ink supply unit 20 so that the rotational speed of the pulse motor 86 may be maintained at a predetermined speed.

Since the rate of the ink ejected from the ink nozzle 18 is determined by the speed of the plunger 52 moving forward as described above, the rate of the ink being ejected can be regulated precisely. As a result, the printing density of data printed on the wrapping paper P can be maintained in a limited range. Here, since the ink is ejected from the ink nozzle 18 by the plunger 52 being pushed forward, the rate of the ink being ejected does not show pulsation, so that the printing density can be stabilized effectively.

When the ink cartridge 50 empties, the cigarette manufacturing machine is stopped, and the ink cartridge 50 is replaced with another one.

Specifically, the ink cartridge 50 is replaced as follows: First, the end disc 56 is detached from the cartridge holder 40. Then, the push rod 82 of the linear actuator 80 is expanded further, so that the ink cartridge 50 is ejected from the cartridge holder 50 by the push rod 82. Then, when the push rod 82 of the linear actuator 80 is contacted to a standby position, with the ink cartridge 50 being kept in the ejected state, the empty ink cartridge 50 is released from the push rod 82. Thus, the cartridge 50 is unloaded from the cartridge holder 40. Next, a new ink cartridge 50 charged with ink is inserted in the cartridge holder 40. After the ink cartridge 50 has been loaded into the cartridge holder 40, the end disc 56 is attached to the cartridge holder 40 again.

Since the axis of the ink cartridge holder 40 is parallel with the axes of the inlet rollers 8, 10, the inlet rollers 8, 10 do not hinder the ink cartridge 50 being loaded into or unloaded from the ink cartridge holder 40.

When cigarette rods of another brand are to be manufactured, the ink now used in the printing device 2 may need to be replaced with ink of another color. In that case, the ink cartridge 50 now in use is removed from the cartridge holder 40 in the same way. Then, the inside of the ink supply passage 79 and the inside of the ink nozzle 18 are cleaned, and then an ink cartridge charged with ink of a desired color is load into the cartridge holder 40 in the same way.

Since the ink supply passage 79 is only formed in the cartridge holder 40 that is also a member for having the ink nozzle 18 attached to, the entire length of the ink supply passage 79 is short. In addition, the end disc 56 in which part of the ink supply passage is formed can be detached from the front cylinder 42. Thus, the ink supply passage 79 can be cleaned easily.

Further, as described above, the ink nozzle 18 includes two nozzle halves 18*a* and 18*b*, and can be disassembled in order to clean the inside thereof. Thus, the inside of the ink nozzle 18 can be cleaned easily. As a result, in the printing device 2, ink colors can be changed easily. This contributes much to increasing the working ratio of the cigarette manufacturing machine, or in other words, the productivity thereof.

The present invention is not restricted to the above-described embodiment. It allows various modifications. For example, the specific structures of the ink nozzle 18 and the cartridge holder 40 may be modified. Instead of the ink supply passage 79 formed in the cartridge holder 40, an ink tube may connect the discharge tap 60 of the ink cartridge holder 50 and the ink nozzle 18. Further, a linear motor may be used in place of the linear actuator 80. Modifications like these do not depart from the concept and range of the present invention. Further, the attached claims are intended to encompass improvements that are obvious to a person skilled in this technical field.

What is claimed is:

1. A printing device for printing on wrapping paper fed to a cigarette manufacturing machine, comprising:

a printing roller train for printing predetermined data on the wrapping paper, having a pair of inlet rollers at a starting end of said train and a printing roller at a terminal end of said train;

an ink nozzle for ejecting ink between said pair of inlet rollers; and an ink supply unit for supplying ink to said ink nozzle, wherein said ink supply unit includes:

an ink cartridge having an ink chamber defined by a movable wall therein and filled with ink, and an ink discharge port, an ink supply passage connecting the ink discharge port disposed on one end of said ink cartridge, a linear actuator for pushing said movable wall into an opposite end of said ink cartridge, and control means for controlling said linear actuator, the ink nozzle being disposed adjacent to a side of said ink cartridge in a position between the two ends of the cartridge.

2. The printing device according to claim 1, wherein said ink supply unit further includes a cartridge holder for detachably housing said ink cartridge, said cartridge holder being located near said ink nozzle.

3. The printing device according to claim 2, wherein said cartridge holder has a nozzle mount for attaching said ink nozzle thereto, at an outside surface of said cartridge holder.

4. The printing device according to claim 3, wherein said nozzle mount has a nozzle connecting opening adapted to connect with an inside of said ink nozzle, and said ink supply passage is defined in said cartridge holder.

5. The printing device according to claim 4, wherein said cartridge holder includes a cylinder that opens at both ends and has a containing chamber adapted to house said ink cartridge therein, and an end wall for closing one of the open ends of said cylinder, and said end wall has a cartridge connecting hole adapted to be detachably inserted into the ink discharge port of said ink cartridge when said ink cartridge is housed in said cylinder, and the cartridge connecting hole defines an end of said ink supply passage.

6. The printing device according to claim 5, wherein said end wall is detachably attached to said cylinder.

7. The printing device according to claim 6, wherein said cartridge holder is arranged to extend along axes of said inlet rollers, and said nozzle mount is provided at an outer peripheral surface of said cylinder.

8. The printing device according to claim 7, wherein said linear actuator is supported at the other of the open ends of said cylinder and has a push rod projecting into said cylinder, and the push rod is adapted to push said movable wall when the push rod is expanded and to separate from said movable wall when the push rod is contracted.

9. The printing device according to claim 4, wherein said ink nozzle is detachably attached to said nozzle mount.

10. The printing device according to claim 9, wherein said ink nozzle includes a separable pair of nozzle halves, and an internal passage formed between the nozzle halves to extend from the nozzle connecting opening to a tip end of said ink nozzle.

11. The printing device according to claim 1, wherein:

said control means includes a sensor for detecting density of the data printed on said wrapping paper and sending out a corresponding detection signal, and regulating means for regulating speed of said movable wall being pushed in by said linear actuator, based on the detection signal from the sensor.

12. A printing device for printing on wrapping paper fed to a cigarette manufacturing machine, comprising:

a printing roller train for printing predetermined data on the wrapping paper, having a pair of inlet rollers at a starting end of said train and a printing roller at a terminal end of said train;

an ink nozzle for ejecting ink between said pair of inlet rollers; and an ink supply unit for supplying ink to said ink nozzle, said ink supply unit including:

an ink cartridge having an ink chamber defined by a movable wall therein and filled with ink, and an ink discharge port;

a cartridge holder for detachably housing said ink cartridge, said cartridge holder being located near said ink nozzle and having a nozzle mount for attaching said ink nozzle thereto at an outside surface of said cartridge holder, said nozzle mount having a nozzle connecting opening adapted to connect with an inside of said ink nozzle, wherein said cartridge holder includes a cylinder that opens at both ends and has a containing chamber adapted to house said ink cartridge therein and an end wall for closing one of the open ends of said cylinder, said end wall having a cartridge connecting hole adapted to be detachably inserted into the ink discharge port of said ink cartridge when said ink cartridge is housed in said cylinder;

an ink supply passage connecting the ink discharge port of said ink cartridge and said ink nozzle, said ink supply passage being defined in said cartridge holder and said cartridge connecting hole defining an end of said ink supply passage;

a linear actuator for pushing said movable wall into said ink cartridge, and control means for controlling action of said linear actuator.

13. A printing device for printing on wrapping paper fed to a cigarette manufacturing machine, comprising:

a printing roller train for printing predetermined data on the wrapping paper, having a pair of inlet rollers at a starting end of said train and a printing roller at a terminal end of said train;

an ink nozzle for ejecting ink between said pair of inlet rollers; and an ink supply unit for supplying ink to said ink nozzle, wherein said ink supply unit includes:

an ink cartridge having an ink chamber defined by a movable wall therein and filled with ink, and an ink discharge port, an ink supply passage connecting the ink discharge port of said ink cartridge and said ink nozzle, a linear actuator for pushing said movable wall into said ink cartridge, and wherein the ink supply passage extends from a discharge tap at a closed end of the ink cartridge to a nozzle passage of the ink nozzle, and therebetween, the ink supply passage includes an internal passage of an end disc facing the closed end of the ink cartridge, and an axial hole of a cylindrical cartridge holder.

* * * * *